United States Patent [19]

Murray

[11] 4,178,981

[45] Dec. 18, 1979

[54] COPPER CASTING METHOD USING TITANIUM DIOXIDE RELEASE METHOD

[75] Inventor: Edward C. Murray, Edmond, Okla.

[73] Assignee: Kerr-McGee Corporation, Oklahoma City, Okla.

[21] Appl. No.: 920,466

[22] Filed: Jun. 29, 1978

[51] Int. Cl.[2] ..... B22C 3/00

[52] U.S. Cl. ..... 164/72; 249/115; 427/135

[58] Field of Search ..... 164/72; 427/133, 135; 249/115

[56] References Cited

U.S. PATENT DOCUMENTS

| | | | |
|---|---|---|---|
| 2,050,375 | 8/1936 | Poland | 164/72 |
| 3,126,294 | 3/1964 | Pichler | 164/72 X |
| 3,266,107 | 8/1966 | Groteke | 164/72 X |
| 3,779,816 | 12/1973 | Mao | 427/135 X |
| 3,867,977 | 2/1975 | Cruz et al. | 164/72 |

FOREIGN PATENT DOCUMENTS

| | | | |
|---|---|---|---|
| 2047041 | 4/1971 | Fed. Rep. of Germany | 164/72 |

*Primary Examiner*—Robert D. Baldwin

*Attorney, Agent, or Firm*—William G. Addison

[57] ABSTRACT

A copper mold release material comprising titanium dioxide slurried in a liquid medium. The titanium dioxide is easily removed from a casting, if any adhers thereto, by washing with, for example, water and does not contaminate electrolytes utilized in electrolytic refining processes.

9 Claims, No Drawings

COPPER CASTING METHOD USING TITANIUM DIOXIDE RELEASE METHOD

BACKGROUND OF THE INVENTION

1. Field of the Invention

This invention relates to the casting of copper anodes for use in the electrolytic refining of impure copper and to the casting of refined copper.

2. Description of the Prior Art

Copper anodes used in electrolytic copper refining are normally cast in solid copper molds. In the past, common practice has been to treat the interior surfaces of such a mold before each metal pour with a slurry made up of a finely divided inorganic release material such as silica, suspended in a liquid medium, to prevent the molten metal from welding itself to the mold. The liquid medium is vaporized by the heat of the mold, resulting in deposition of the release material on the interior surfaces of the mold.

U.S. Pat. No. 2,050,375 discloses a copper release material comprised of a mixture of an inert substance selected from the group consisting of bone ash, bone black and graphite or combinations thereof and a suitable adhesive or binder such as rosin, copal, gum arabic, glue, gelatine and the like dissolved in a suitable liquid medium.

U.S. Pat. No. 3,126,294 discloses a copper release material comprised of aluminas which have been calcined at temperatures in the range of between 1800 degrees F. and 2200 degrees F. and dispersed in a liquid medium.

Also, U.S. Pat. No. 3,867,977 discloses copper release materials such as clay, ganister and lime which are dispersed in a liquid medium in addition to the materials previously identified.

Each of these release materials have been used with varying success by the copper refining industry. Recently however, new governmental safety regulations and environmental controls have caused a need for a new material to comply with these new regulations and still provide a mold release agent which is easily removed from the casting and which contains no impurities that will cause contamination or reduction in current efficiency of electrolytic copper refining cells.

SUMMARY OF THE INVENTION

The surprising discovery now has been made that titanium dioxide dispersed in a liquid medium provides a mold release agent suitable for use in casting both pure and impure copper. The titanium dioxide is easily removed from the cast copper, if any adheres thereto, and does not contain any impurities that will contaminate electrolytes utilized in electrolytic refining processes. Further, titanium dioxide is environmentally acceptable, complies with present governmental safety regulations and is an economically acceptable mold release agent.

The preferred titanium dioxide is an agglomerated or deagglomerated type material produced by either the $TiO_2$ Burner Process or Sulfate Process for the production of titanium dioxide which has received no additional surface preparation or chemical surface treatment respectively.

In accordance with conventional practice, the titanium dioxide is slurried in a liquid medium such as water. The slurry is applied to the interior surfaces of a mold by conventional means, such as for example, spraying, splashing and the like to form a coating thereon. The residual heat remaining in the mold from pour to pour vaporizes the liquid medium from the slurry coating, leaving a residual coating of the release material on the interior surfaces of the mold.

DESCRIPTION OF THE PREFERRED EMBODIMENTS

Conventional casting procedures preferably are followed in practicing this invention. The sequence of steps involved in conventional casting operations comprise pouring molten copper into a mold coated with a release material, cooling the mold, removing the solidified copper casting from the mold and applying a fresh coating of the mold release material in the form of a slurry to the interior surfaces of the empty mold. The empty mold then is returned to the pour step and the sequence is repeated. The residual heat remaining in the mold from pour to pour vaporizes the liquid medium from the slurry coating, leaving the release material on the interior surfaces of the mold. The coating of mold release material prevents the molten copper metal from welding itself to the mold.

The mold release material contemplated by this invention is titanium dioxide. The titanium dioxide can be an agglomerated or deagglomerated type material which has received no additional surface preparation or chemical surface treatment, respectively, which has been made by either the $TiO_2$ Burner Process or the Sulfate Process for the production of titanium dioxide suitable for pigmentary purposes. Further, the crystalline structure of the titanium dioxide may be in either the rutile crystal or anatase crystal form. The liquid medium within which the titanium dioxide is dispersed preferably is water; however, other mediums known by those skilled in the art may be employed. The slurry may vary in concentration of titanium dioxide present, depending upon the methods utilized in applying the slurry to the surfaces of the mold.

In spraying operations, the solids content of the slurry can be in the range of from about 2 percent to about 25 percent by weight but preferably is in a range of from about 3 percent to about 10 percent by weight. The quantity of slurry deposited on the interior surfaces of the mold should be such that a continuous homogenous coating is produced. The thickness of such a coating will normally be less than 5 mils. The particle size of the solids in the slurry can vary over a wide range but preferably is in a range of from about 0.1 micron to about 200 microns in diameter, and for spraying operations, most preferably from about 0.1 micron to about 75 microns.

In splashing and other methods of applying the slurry to the mold surface, the concentration of the solids can be as high as 25 percent by weight. In these methods the particle size is even less critical, the only requirements being that a homogenous slurry is maintained and that the coating which is applied be uniform.

The temperature of the mold during application of the slurry generally is in the range of from about 200 degrees F. to about 1000 degrees F. The residual heat remaining in the mold, as hereinbefore mentioned, vaporizes the liquid medium from the slurry leaving a residual coating of the release material on the interior surfaces of the mold.

The invention is further described by reference to the following examples which are set forth for purposes of illustration only and without any intention that the invention be limited thereby.

EXAMPLE 1

A copper mold approximately 4 inches wide by 2 inches deep by 12 inches long having a cavity in one surface which was about 1 inch wide by 1 inch deep by 8 inches long was suspended in a cradle. The mold could be rotated such that a copper casting could be removed by inverting the mold. The mold initially was heated to a temperature of about 300 degrees F. to simulate continuous operations and the mold interior surfaces were sprayed with a water slurry of the mold release agent of the present invention. The water slurry contained 8–10 percent by weight deagglomerated titanium dioxide with no chemical surface treatment. Molten copper at 2050 degrees F. was poured into the coated mold from a graphite crucible. The mold then was cooled with a water spray, rotated, and the casting removed. The casting process then was repeated two additional times. The castings were bright and clean with no adhering mold release material.

EXAMPLE 2

Copper castings were prepared as stated in Example 1 with a water slurry containing 8–10 percent by weight agglomerated titanium dioxide with no additional surface preparation. The castings were bright and clean with no adhering mold release material.

EXAMPLE 3

Copper castings were prepared as stated in Example 1 with a water slurry containing 8–10 percent by weight deagglomerated titanium dioxide which had received chemical surface treatment with aluminium oxide. The castings were rough and showed evidence of gas evolution at the mold-casting interface. Mold release material which adhered to the castings was removed by washing with water.

It is to be understood that changes can be made in the above described formulation and process without departing from the spirit and scope of the invention as defined by the following claims.

What is claimed is:

1. In the casting of copper in a mold wherein, the internal surface of the mold initially is coated with a release material slurried in a liquid medium, the mold then is filled with molten copper, and thereafter cooled and solidified copper is removed from the mold, the improvement which comprises utilizing as the release material a material consisting essentially of titanium dioxide in a particulate form having a particle size in the range of from about 0.1 micron to about 200 microns.

2. The process of claim 1 wherein the titanium dioxide is of the deagglomerated type with no additional chemical surface treatment.

3. The process of claim 1 wherein the titanium dioxide is of the agglomerated type with no additional surface preparation.

4. The process of claim 1 wherein the titanium dioxide is of the rutile crystal structure.

5. The process of claim 1 wherein the titanium dioxide is of the anatase crystal structure.

6. The process of claim 1 wherein the liquid medium is water.

7. The process of claim 1 wherein the particle size of the titanium dioxide is in the range of from about 0.1 micron to about 75 microns.

8. The process of claim 1 wherein the slurry of release material contains from about 2 percent to about 25 percent, by weight, titanium dioxide.

9. The process of claim 8 wherein the slurry of release material preferably contains from about 3 percent to about 10 percent, by weight, titanium dioxide.

* * * * *